US010290403B2

(12) United States Patent
Lee

(10) Patent No.: US 10,290,403 B2
(45) Date of Patent: May 14, 2019

(54) METHODS OF FABRICATING CHIP RESISTORS USING ALUMINUM TERMINAL ELECTRODES

(71) Applicant: National Cheng Kung University, Tainan (TW)

(72) Inventor: Wen-Hsi Lee, Tainan (TW)

(73) Assignee: NATIONAL CHENG KUNG UNIVERSITY, Tainan (TW)

( * ) Notice: Subject to any disclaimer, the term of this patent is extended or adjusted under 35 U.S.C. 154(b) by 0 days.

(21) Appl. No.: 15/380,513

(22) Filed: Dec. 15, 2016

(65) Prior Publication Data

US 2018/0174720 A1 Jun. 21, 2018

(51) Int. Cl.

| | |
|---|---|
| ***H01C 1/01*** | (2006.01) |
| ***H01C 17/00*** | (2006.01) |
| ***H01C 17/28*** | (2006.01) |
| ***C25D 3/56*** | (2006.01) |
| ***C23C 18/50*** | (2006.01) |
| *B05D 1/02* | (2006.01) |

(52) U.S. Cl.

CPC ..... *H01C 17/006* (2013.01); *C23C 18/50* (2013.01); *C25D 3/562* (2013.01); *H01C 1/01* (2013.01); *H01C 17/281* (2013.01); *B05D 1/02* (2013.01)

(58) Field of Classification Search

CPC .. B05D 1/02; C23C 18/54; H01C 1/01; H01C 1/14; H01C 1/146; H01C 17/006; H01C 17/281

USPC ..... 427/58, 101

See application file for complete search history.

(56) References Cited

U.S. PATENT DOCUMENTS

| | | | | |
|---|---|---|---|---|
| 3,472,688 | A * | 10/1969 | Hayashi | H01C 7/00 257/537 |
| 5,815,065 | A * | 9/1998 | Hanamura | H01C 17/006 338/308 |
| 6,166,620 | A * | 12/2000 | Inuzuka | H01C 17/06533 338/308 |
| 6,242,999 | B1 * | 6/2001 | Nakayama | H01C 1/14 338/307 |
| 2001/0030178 | A1 * | 10/2001 | Kaida | H01C 17/242 219/121.69 |
| 2003/0092250 | A1 * | 5/2003 | Kuriyama | H01C 7/003 438/597 |
| 2003/0127706 | A1 * | 7/2003 | Tanimura | H01C 1/142 257/536 |
| 2003/0132828 | A1 * | 7/2003 | Hashimoto | H01C 1/14 338/203 |
| 2009/0231086 | A1 * | 9/2009 | Nomura | H01C 1/012 338/309 |

* cited by examiner

*Primary Examiner* — Brian K Talbot

(74) *Attorney, Agent, or Firm* — Jackson IPG PLLC; Demian K. Jackson

(57) ABSTRACT

Two methods are provided to make aluminum terminal electrodes for chip resistors. For a chip resistor having a high resistance, the structure is not changed but the aluminum terminal electrode must have a high solid content, including a high aluminum content and a high glass content. For porous-aluminum terminal electrodes applied to a chip resistor having a low resistance, a new structure is formed to change current-conducting paths through different sizes of a protecting layer and a resistor layer. Therein, original paths conducting to the resistor layer through front terminal electrodes are changed into new paths conducting to the resistor layer through side terminal electrodes.

11 Claims, 9 Drawing Sheets

(a)

(b)

(a)

(b)

METHODS OF FABRICATING CHIP RESISTORS USING ALUMINUM TERMINAL ELECTRODES

TECHNICAL FIELD OF THE INVENTION

The present invention relates to fabricating terminal electrodes; more particularly, to enhancing the ability of anti-vulcanization of chip resistors with the material cost of terminal electrodes significantly reduced.

DESCRIPTION OF THE RELATED ARTS

The resistance of a chip resistor mainly depends on the material and geometrical structure of the resistor layer. Therein, for conducting out through the front terminal electrodes, a printed circuit board (PCB) is connected by plating nickel and tin. Basically, the terminal electrodes of the chip resistor can be divided into three groups, namely the front terminal electrodes, the rear terminal electrodes and the side terminal electrodes. Therein, the side terminal electrodes and the rear terminal electrodes are only used for plating nickel and tin afterward. The front terminal electrodes are not only used for plating nickel and tin but also in charge of forming paths to connect to the resistor layer, i.e. to connect plated nickel and tin to the resistor layer for being welded on the PCB, as revealed in the patent U.S. Pat. No. 6,153,256. Of no doubt, there are techniques for connecting to the resistor layer through the rear terminal electrodes, whose principle is the same as those for connecting to the resistor layer through the front terminal electrodes. In order to form an ohmic contact with the resistor layer, the conductivity of the front terminal electrodes must be much lower than that of the resistor layer to form the ohmic contact; otherwise, parasitic resistance will be generated to affect the final resistance of the chip resistor.

In order to meet the functions of the terminal electrodes for the chip resistor with the consideration of cost, new chip resistors mainly use silver as the conductive material for the terminal electrodes. However, the silver terminal electrodes for chip resistors have a serious drawback. The electrodes are reacted with sulfur to form silver sulfide in the application environment, especially under a high temperature, high humidity, and a high sulfur concentration. For example, the automotive electronics applications may have intense and severe reactions particularly, where the vulcanization of the chip resistors is shown in picture (b) of FIG. 6. The silver sulfide thus generated will affect the electrical properties and reliability of the chip resistors.

At present, for producing anti-vulcanizing chip resistors used in cars, with high contents of palladium (above 5 mol %) are added to the silver terminal electrodes to form a silver-palladium alloy for reducing the reactive activity of sulfur on forming silver sulfide, as revealed in the patent U.S. Pat. No. 5,966,067. However, the cost of the electrodes will dramatically rise. When the vulcanization environment becomes harsh, a particular risk remains forg silver sulfide generated.

Moreover, when aluminum electrodes are used in the chip resistor having a high resistance (>1Ω) with the structure remained the same, the situation is still different from what the silver terminal electrodes may encounter. When the silver terminal electrodes are used in the chip resistor, the surface of the silver terminal electrodes may be easily oxidized to generate extra parasitic resistance. When the chip resistor is processed through a test of short-time overload with 2.5 times of a rated voltage, the parasitic resistance may be easily generated owing to the impact on the terminal electrodes and the chip resistors may be thus fail owing to the over-deviated resistance (±2%) after the test of short-time overload.

Hence, the prior arts do not fulfill all users' requests on actual use.

SUMMARY OF THE INVENTION

The main purpose of the present invention is to provide a terminal electrode having a high solid content of aluminum to replace the original silver terminal electrode for applying to the chip resistors having resistance greater than 1Ω; and to provide a porous-aluminum terminal electrode to replace the original silver terminal electrode for applying to the chip resistors having resistance smaller than 1Ω, where the cost of the terminal electrodes is greatly reduced and the vulcanization problem of the silver terminal electrodes used in chip resistor is completely solved for applications in cars, base stations, and LED lights with the enhanced ability of anti-vulcanization for chip resistor.

Another purpose of the present invention is to provide a new material and structure of terminal electrode for chip resistor by using low-cost aluminum terminal electrodes to replace the high-price silver terminal electrodes. When the aluminum terminal electrodes are applied to a chip resistor having a high resistance (>1Ω), the structure is not changed. What is different from the original procedure for fabricating the silver terminal electrode used in chip resistor is that the aluminum terminal electrode may be easily oxidized on surface with extra parasitic resistance generated. When the chip resistors are processed through the test of short-time overload with 2.5 times of a rated voltage during fabrication, the parasitic resistance may be easily generated owing to impacting the aluminum terminal electrodes and the chip resistors may thus fail owing to the over-deviated resistance (±2%) after the test of short-time overload.

With a great amount of glass added to the thick-film aluminum paste, the aluminum paste in one hand avoids over-oxidation during sintering because the great amount of glass will be adhered on surface of aluminum particles. In the other hand, with the great amount of glass added, pores leftover after sintering the thick-film aluminum paste are filled to greatly enhance the density of the aluminum electrode made of the thick-film aluminum paste.

Thus, the chip resistor using the aluminum terminal electrodes passes the test of short-time overload just as the chip resistor using the silver terminal electrodes does, which has a qualified resistance deviation of ±2% or even smaller for ±0.1%. When the porous-aluminum terminal electrodes are applied in the chip resistor having a smaller resistance (<1Ω), current conducting path is changed by the new structure having the different sizes of the protecting layer and the resistor layer, where the original paths of conducting the resistor layer through the aluminum front electrodes is changed to the new paths of conducting the resistor layer through the side electrodes. Or, the resistor layer may keep its original structure; that is to say, the protecting layer and the resistor layer have the same size or the resistor layer is bigger. Therein, on plating the side electrodes for fabricating the chip resistor, the plated nickel is permeated and fully filled into the pores of the original porous-aluminum electrodes to form new low-resistance terminal electrodes of aluminum and nickel co-existed.

To achieve the above purposes, the present invention is methods of fabricating aluminum terminal electrodes for chip resistor. A first preferred embodiment comprises the steps of: (a) printing and sintering aluminum terminal electrodes, comprising steps of (a1) printing a plurality of pairs of aluminum rear electrodes on a back side of a substrate, where each pair of the aluminum rear electrodes are intervallic and unconnected; (a2) printing a plurality of pairs of aluminum front electrodes on a front side of the substrate, where each pair of the aluminum front electrodes are intervallic and unconnected; and (a3) putting the substrate into a sintering furnace to sinter the aluminum front electrodes and the aluminum rear electrodes to the substrate at a high temperature of 600~900 celsius degrees (° C.); (b) printing and sintering a resistor layer, comprising steps of (b1) printing a resistor layer between each pair of the aluminum front electrodes on the front side of the substrate, where two ends of the resistor layer are separately extended to the pair of the aluminum front electrodes and overlapped on two intervallic and unconnected ends of the pair of the aluminum front electrodes; and (b2) putting the substrate into a sintering furnace to sinter the resistor layer to the substrate at a high temperature of 600~900° C.; (c) printing and sintering a protecting layer, comprising steps of (c1) printing a protecting layer on the resistor layer, where the protecting layer has a size not smaller than the resistor layer; and (c2) putting the substrate into a sintering furnace to sinter the protecting layer to the resistor layer at a high temperature of 450~700° C.; (d) laser-cutting, where the substrate is put into a laser-cutting device to cut the resistor layer with a laser; and where an adjusting groove having a desired shape is cut out on the resistor layer to adjust a resistance of the resistor layer; (e) printing a mark, where a mark is printed on the protecting layer for chip resistor identification; (f) strip-splitting, where the substrate having a sheet shape is put into a rolling device to be split into a plurality of strips of the substrate through pushing bending; (g) printing side electrodes, comprising steps of (g1) printing a conductive material on two side surfaces of each one of the strips of the substrate to obtain two side electrodes on the two ends of the resistor layer, where the side electrodes cover the aluminum front electrodes and the aluminum rear electrodes; and (g2) putting the substrate strips in a sintering furnace to sinter the side electrodes to the aluminum front electrodes and the aluminum rear electrodes at a temperature of 150~250° C. to obtain connection and conduct electricity between pairs of the aluminum front electrodes and the aluminum rear electrodes at the same side of the substrate, where the side electrodes are in contact with the aluminum front electrodes to further connect to the resistor layer; (h) chip-splitting, where, after sintering the side electrodes, each one of the strips of the substrate is split by a rolling device through pushing bending; and where a plurality of serially-arranged chip resistors consisted in each one of the strips of the substrate are split into independent dices of the chip resistors and each one of the dices of the chip resistors comprises the two aluminum front electrodes, the two aluminum rear electrodes, the two side electrodes, the resistor layer, and the protecting layer; and (i) plating, where the dices of the chip resistors are put into a plating bath to be plated with nickel and tin; and where nickel is plated to protect the two aluminum front electrodes and tin is plated to weld the chip resistor onto a printed circuit board (PCB), where the chip resistors using the aluminum terminal electrodes are anti-vulcanizing chip resistors applied to cars, base stations, and LED lights.

In a first state-of-use of the first preferred embodiment, the aluminum front electrode has a high solid content and the high solid content comprises a high solid content of aluminum and a high solid content of glass; and the aluminum front electrode is applied to a chip resistor having a resistance not smaller than 1Ω.

In the first state-of-use of the first preferred embodiment, the high solid content of the aluminum front electrode is higher than 70 wt %, comprising the high solid content of aluminum higher than 64 wt % and the high solid content of glass higher than 6 wt %; and, after a test of short-time overload with 2.5 times of a rated voltage, ΔR/R is controlled within ±2% as required specification.

In the first state-of-use of the first preferred embodiment, the high solid content of the aluminum front electrode is higher than 74 wt %, comprising the high solid content of aluminum higher than 64 wt % and the high solid content of glass higher than 10 wt %; and, after a test of short-time overload with 2.5 times of a rated voltage, ΔR/R is controlled within ±0.1% as far lower than required specification.

In the second state-of-use of the first preferred embodiment, the aluminum front electrode has a low solid content of porous aluminum; and the aluminum front electrode is applied to a chip resistor having a resistance smaller than 1Ω.

In the second state-of-use of the first preferred embodiment, the aluminum front electrode has the low solid content of porous aluminum lower than 44 wt % and a high solid content of glass higher than 6 wt %.

A first preferred embodiment comprises the steps of: (a) printing and sintering aluminum terminal electrodes, comprising steps of (a1) printing a plurality of pairs of aluminum rear electrodes on a back side of a substrate, where each pair of the aluminum rear electrodes are intervallic and unconnected; (a2) printing a plurality of pairs of aluminum front electrodes on a front side of the substrate, where each pair of the aluminum front electrodes are intervallic and unconnected; and (a3) putting the substrate into a sintering furnace to sinter the two aluminum front electrodes and the two aluminum rear electrodes to the substrate at a high temperature of 600~900° C., where the aluminum front electrode has a low solid content of porous aluminum; (b) printing and sintering a resistor layer, comprising steps of (b1) printing a resistor layer between the two aluminum front electrodes on the front side of the substrate, where two ends of the resistor layer are separately extended to and overlapped on two intervallic and unconnected ends of the two aluminum front electrodes; and (b2) placing the substrate into a sintering furnace to sinter the resistor layer to the substrate at a high temperature of 600~900° C.; (c) printing and sintering an inner coating layer, comprising steps of (c1) printing an inner coating layer on the resistor layer, where the inner coating layer has a size smaller than the resistor layer and is not in contact with the two aluminum front electrodes to expose two ends of the resistor layer; and (c2) putting the substrate into a sintering furnace to sinter the inner coating layer to the resistor layer at a high temperature of 450~700° C.; (d) laser-cutting, where the substrate is put into a laser-cutting device to cut the resistor layer with a laser; and where an adjusting groove having a desired shape is cut out on the resistor layer to adjust a resistance of the resistor layer; (e) printing and sintering an outer coating layer, comprising steps of (e1) printing an outer coating layer on the inner coating layer, where the outer coating layer has a size the same as the inner coating layer; and where the outer coating layer has a size smaller than the resistor layer and is not in contact with the two aluminum front electrodes to expose two ends of the resistor layer; and (e2) putting the substrate into a sintering furnace to sinter the outer coating layer to the inner coating layer at a high temperature of 450~700° C. to obtain a protecting layer comprising the inner coating layer and the outer coating layer; (f) printing a mark, where a mark is printed on the protecting layer for chip resistor identification; (g) strip-splitting, where the substrate having a sheet shape is put into a rolling device to be split into a plurality of substrate strips through pushing bending; (h) printing side electrodes, comprising steps of (h1) printing a conductive material on two side surfaces of each one of the strips of the substrate to obtain two side electrodes on the two ends of the resistor layer separately, where the side electrodes cover the aluminum front electrodes and the aluminum rear electrodes; and (h2) putting the substrate strips in a sintering furnace to sinter the side electrodes to the aluminum front electrodes and the aluminum rear electrodes at a temperature of 150~250° C., where each one of the two aluminum front electrodes is connected to a corresponding one of the aluminum rear electrodes through a corresponding one of the side electrodes at the same side of the substrate; and where the side electrodes are further connected with the resistor layer through the aluminum front electrodes; (i) chip-splitting, wherein, after sintering the side electrodes, each one of the strips of the substrate is split by a rolling device through pushing bending; and where a plurality of serially-arranged chip resistors consisted in each one of the strips of the substrate are split into independent dices of the chip resistors and each one of the dices of the chip resistors comprises the two aluminum front electrodes, the two aluminum rear electrodes, the two side electrodes, the resistor layer, and a protecting layer comprising the inner coating layer and the outer coating layer; and (j) plating, where the dices of the chip resistors is put into a plating bath to be plated with nickel and tin; where nickel is plated to protect the aluminum front electrodes and to fill pores of the low solid content of porous aluminum of the aluminum front electrodes to obtain aluminum/nickel front electrodes; and where tin is plated to weld the chip resistor onto a PCB, where the chip resistors using the aluminum terminal electrodes are anti-vulcanizing chip resistors applied to cars, base stations, and LED lights.

In the second preferred embodiment, the aluminum front electrode having the low solid content of porous aluminum is applied to a chip resistor having a resistance smaller than 1Ω.

In the second preferred embodiment, the low solid content of porous aluminum of the aluminum front electrode is lower than 44 wt % and a high solid content of glass of the aluminum front electrode is higher than 6 wt %.

In the second preferred embodiment, the protecting layer has a size smaller than the resistor layer for at least 1 micrometer (μm).

Accordingly, novel methods of fabricating aluminum terminal electrodes for chip resistor are obtained.

BRIEF DESCRIPTION OF THE DRAWINGS

The present invention will be better understood from the following detailed description of the preferred embodiments according to the present invention, taken in conjunction with the accompanying drawings, in which.

DESCRIPTION OF THE PREFERRED EMBODIMENTS

The following description of the preferred embodiments is provided to understand the features and the structures of the present invention.

Please refer to FIG. 1~FIG. 7, which are flow views showing a first and a second preferred embodiments according to the present invention; structural and sectional views showing a chip resistor fabricated according to the first preferred embodiment; structural and sectional views showing a chip resistor fabricated according to the second preferred embodiment; a view showing sintered aluminum electrodes having different glass contents; a view showing the sintered aluminum electrodes fabricated according to the first and the second preferred embodiments; and a view showing the vulcanization of the present invention and the prior art. As shown in the figures, the present invention is methods of fabricating aluminum terminal electrodes for chip resistors. An alumina-based ceramic substrate is used with the coordination of thick-film printing for fabricating aluminum terminal electrodes used in chip resistors through sequential processes of printing and sintering aluminum terminal electrodes, printing and sintering resistor layer, printing and sintering protecting layer, laser-cutting, printing mark layer, strip-splitting, printing side electrodes, chip-splitting, and plating.

Figure 1:
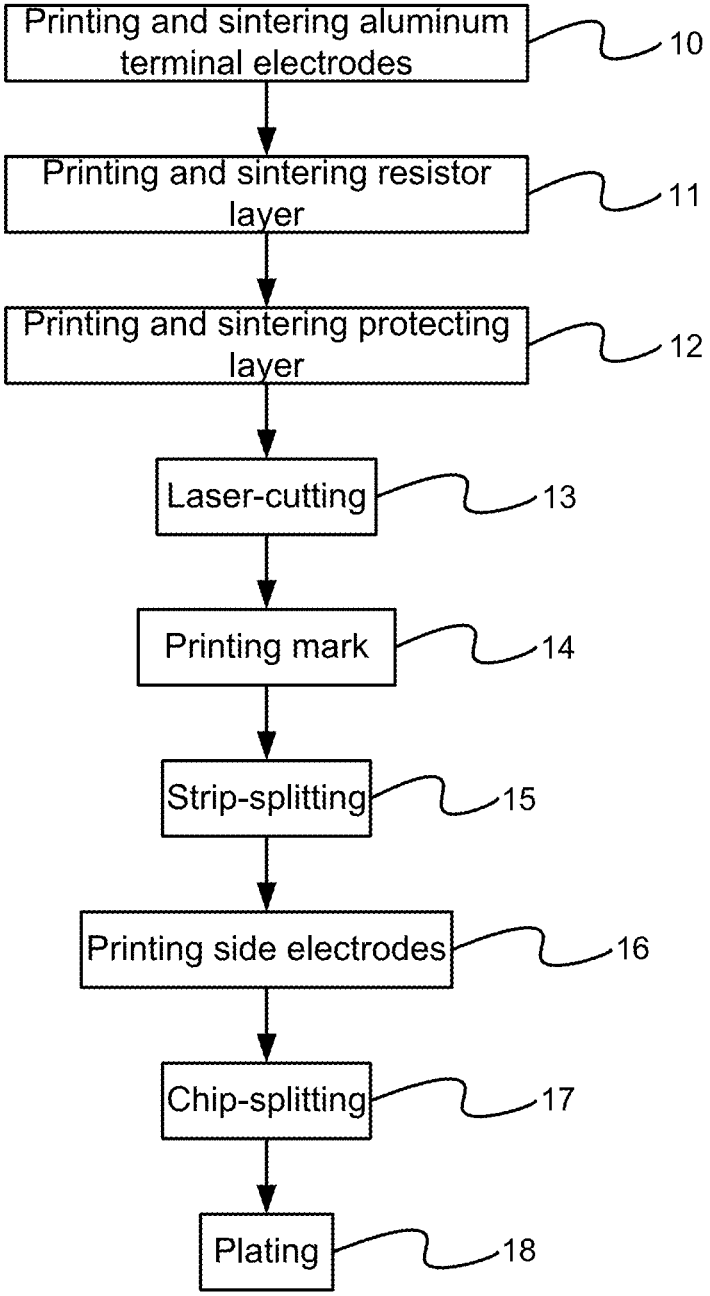
FIG. 1 is the flow view showing the first preferred embodiment according to the present invention.
Figure 3A:
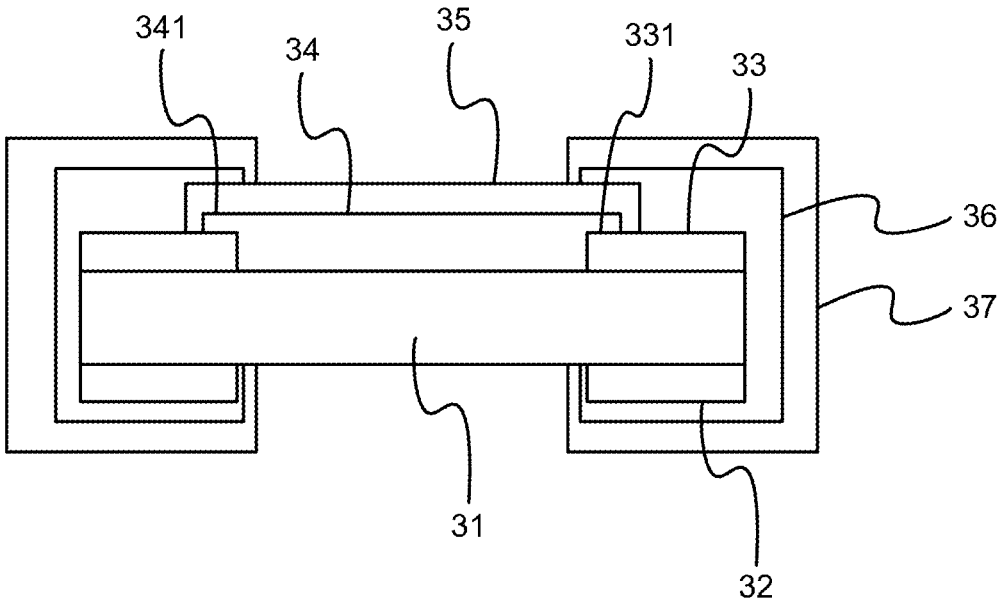
FIG. 3A is the structural view showing the chip resistor fabricated according to the first preferred embodiment.
Figure 3B:
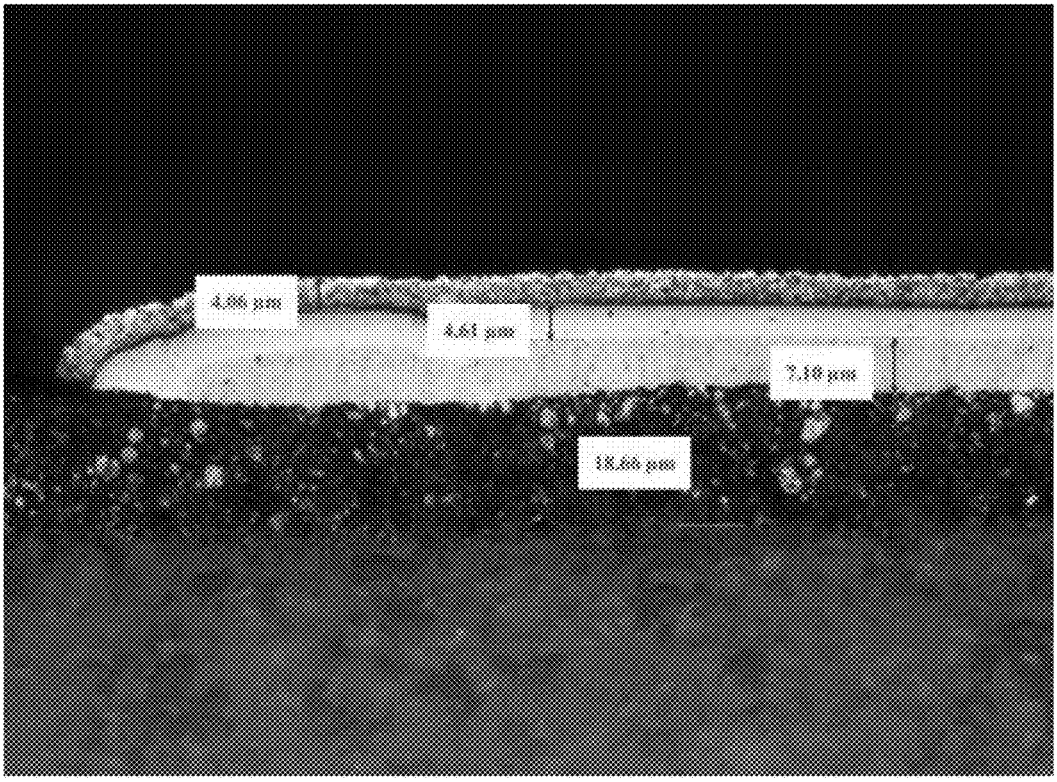
FIG. 3B is the sectional view showing the chip resistor fabricated according to the first preferred embodiment.

As shown in FIG. 1 and FIG. 3A, a first preferred embodiment according to the present invention comprises the following steps:

(a) Printing and sintering aluminum terminal electrodes 10: At first, a plurality of pairs of aluminum rear electrodes 32 are printed on a back side of a substrate 31, where each pair of the aluminum rear electrodes 32 are intervallic and unconnected. Then, a plurality of pairs of aluminum front electrodes 33 are printed on a front side of the substrate 31, where each pair of the aluminum front electrodes 33 are intervallic and unconnected. Then, the substrate 31 is put into a sintering furnace to sinter the aluminum front electrodes 33 and the aluminum rear electrodes 32 to the substrate 31 at a high temperature of 600~900 celsius degrees (° C.).

(b) Printing and sintering a resistor layer 11: A resistor layer 34 is printed between each pair of the intervallic and unconnected aluminum front electrodes 33 on the substrate 31, where two ends 341 of the resistor layer are separately extended to the pair of the aluminum front electrodes 33 and overlapped on two intervallic and unconnected ends 331 of the pair of the aluminum front electrodes 33. Then, the substrate 31 is put into a sintering furnace to sinter the resistor layer 34 to the substrate 31 at a high temperature of 600~900° C.

(c) Printing and sintering a protecting layer 12: A protecting layer 35 is printed on the resistor layer 34. Therein, the protecting layer 35 has a size not smaller than the resistor layer 34. Then, the substrate 31 is put into a sintering furnace to sinter the protecting layer 35 to the resistor layer 34 at a high temperature of 450~700° C.

(d) Laser-cutting 13: The substrate 31 is put into a laser-cutting device to cut the resistor layer 34 with a laser through the protecting layer 35, where an adjusting groove having a desired shape (e.g. a shape of 'I', 'L', etc.) is cut out on the resistor layer 34 to adjust a resistance of the resistor layer 34.

(e) Printing a mark 14: A mark, e.g. type mark, resistance mark, etc., is printed on the protecting layer 35 for chip resistor identification.

(f) Strip-splitting 15: The substrate 31 having a sheet shape is put into a rolling device to be split into a plurality of strips of the substrate 31 through pushing bending.

(g) Printing side electrodes 16: After splitting the substrate 31, a conductive material is printed on two side surfaces of each one of the strips of the substrate 31 to form two side electrodes on the two ends 341 of the resistor layer 34, where the side electrodes 36 cover the aluminum front electrodes 33 and the aluminum rear electrodes 32. Then, the substrate 31 is put into a sintering furnace to sinter the side electrodes 36 to the aluminum front electrodes 33 and the aluminum rear electrodes 32 at a temperature of 150~250° C. for setting connection and conducting electricity between the aluminum front electrodes 33 and the aluminum rear electrodes 32 at the same side of the substrate 31. Therein, the side electrodes 36 are in contact with the aluminum front electrodes 33 to further connect to the resistor layer 34; and the side electrodes 36 is a metal electrode of copper, nickel, tin, or a combination thereof.

(h) Chip-splitting 17: After sintering the side electrodes 36, each one of the strips of the substrate 31 is split by a rolling device through pushing bending. A plurality of serially-arranged chip resistors consisted in each one of the strips of the substrate 31 are split into independent dices of the chip resistors, where each one of the dices of the chip resistors comprises two of the aluminum front electrodes 33, two of the aluminum rear electrodes 32, two of the side electrodes 36, the resistor layer 34, and the protecting layer 35.

(i) Plating 18: The dices of the chip resistors are put into a plating bath to be plated. A plating layer 37 is plated to be covered on each one of the side electrodes 36. The plating layer 37 comprises a layer of nickel and a layer of tin. The layer of nickel is used to protect the aluminum front electrodes 33; and, the layer of tin is used to weld the chip resistor onto a printed circuit board (PCB). The chip resistors using the aluminum terminal electrodes are anti-vulcanizing chip resistors applied to cars, base stations, and LED lights.

The aluminum front electrodes 33 have a high solid content; and, the high solid content comprises a high solid content of aluminum and a high solid content of glass.

Figure 2:
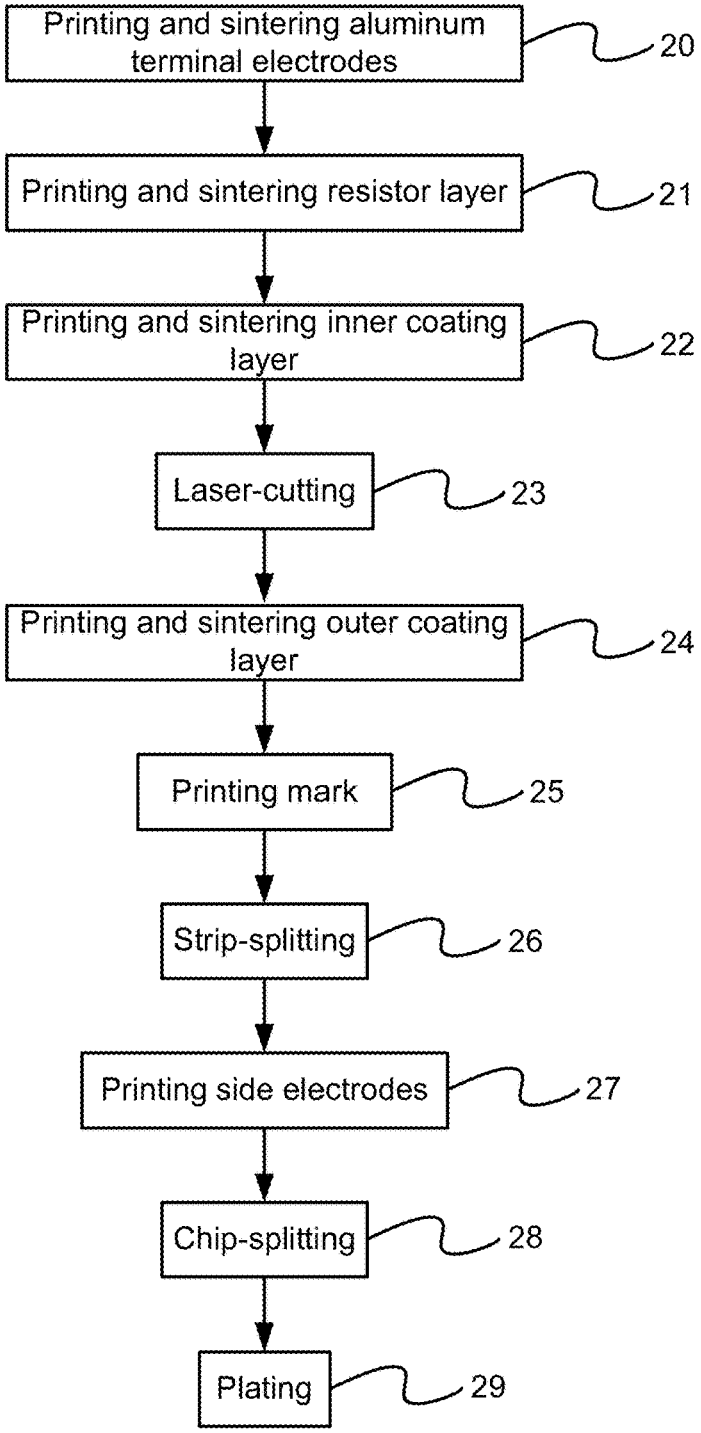
FIG. 2 is the flow view showing the second preferred embodiment according to the present invention.
Figure 4A:
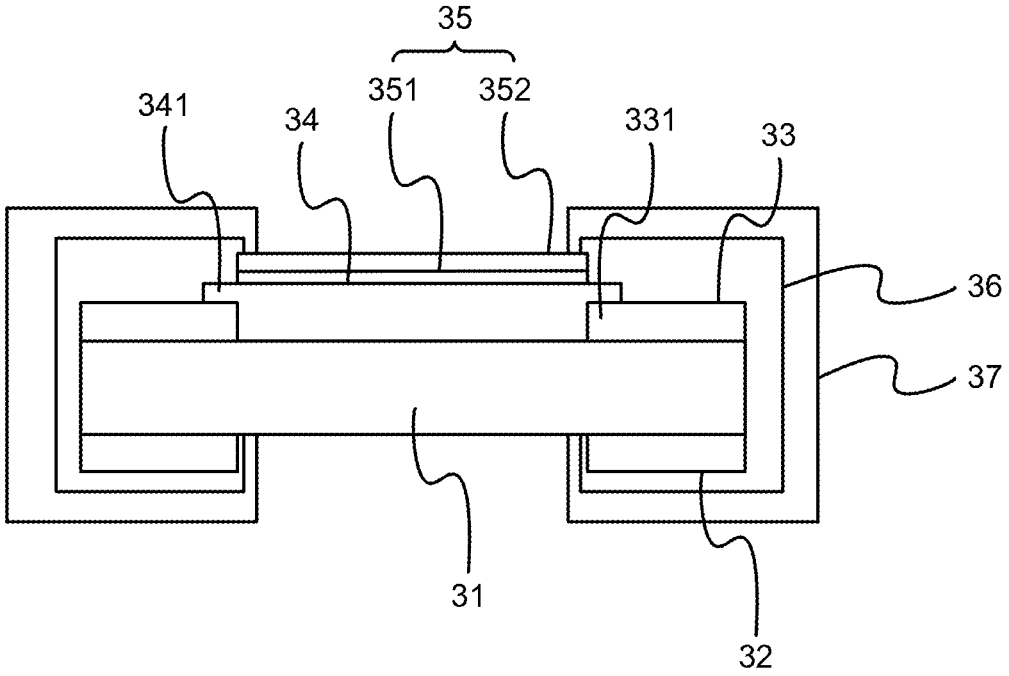
FIG. 4A is the structural view showing the chip resistor fabricated according to the second preferred embodiment.
Figure 4B:
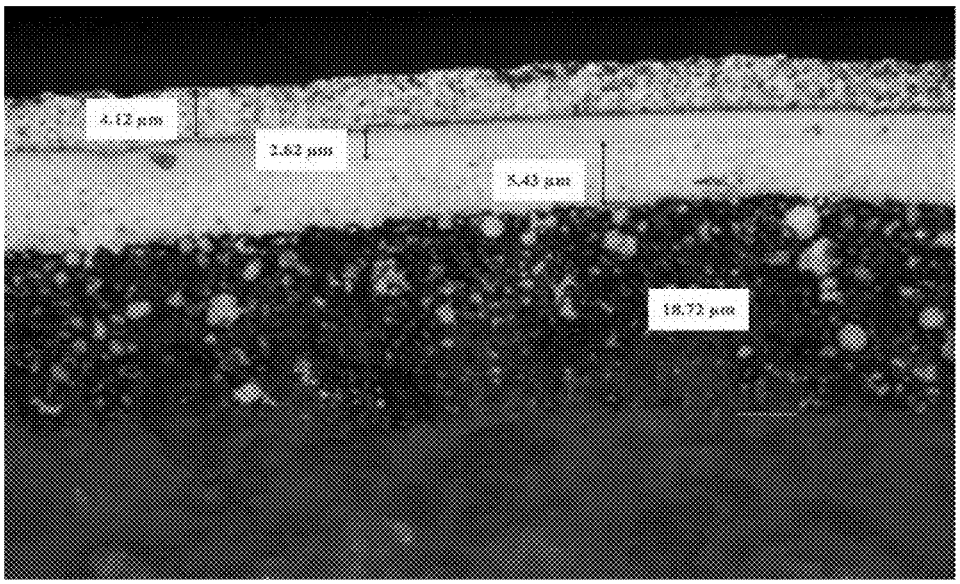
FIG. 4B is the sectional view showing the chip resistor fabricated according to the second preferred embodiment.

As shown in FIG. 2 and FIG. 4A, a second preferred embodiment according to the present invention comprises the following steps:

(a) Printing and sintering aluminum terminal electrodes 20: At first, a plurality of pairs of aluminum rear electrodes 32 are printed on a back side of a substrate 31, where each pair of the aluminum rear electrodes 32 are intervallic and unconnected. Then, a plurality of pairs of aluminum front electrodes 33 are printed on a front side of the substrate 31, where each pair of the aluminum front electrodes 33 are intervallic and unconnected. Then, the substrate 31 is put into a sintering furnace to sinter the aluminum front electrodes 33 and the aluminum rear electrodes 32 to the substrate 31 at a high temperature of 600~900 celsius degrees (° C.). Therein, the aluminum front electrode 33 has a low solid content of porous aluminum.

(b) Printing and sintering a resistor layer 21: A resistor layer 34 is printed between each pair of the intervallic and unconnected aluminum front electrodes 33 on the substrate 31, where two ends 341 of the resistor layer 34 are separately extended to the pair of the aluminum front electrodes 33 and overlapped on two intervallic and unconnected ends 331 of the pair of the aluminum front electrodes 33. Then, the substrate 31 is put into a sintering furnace to sinter the resistor layer 34 to the substrate 31 at a high temperature of 600~900° C.

(c) Printing and sintering an inner coating layer 22: An inner coating layer 351 is printed on the resistor layer 34. Therein, the inner coating layer 351 has a size smaller than the resistor layer 34 and is not in contact with the aluminum front electrodes 33 to expose two ends of the resistor layer 34. Then, the substrate 31 is put into a sintering furnace to sinter the inner coating layer 351 to the resistor layer 34 at a high temperature of 450~700° C. Therein, the inner coating layer 351 is an insulator mainly consisting of glass.

(d) Laser-cutting 23: The substrate 31 is put into a laser-cutting device to cut the resistor layer 34 through the inner coating layer 351 with a laser, where an adjusting groove having a desired shape (e.g. a shape of 'I', 'L', etc.) is cut out on the resistor layer 34 to adjust a resistance.

(e) Printing and sintering an outer coating layer 24: An outer coating layer 352 is further printed on the inner coating layer 351. Therein, the outer coating layer 352 has a size the same as the inner coating layer 351; and the outer coating layer 352 has a size smaller than the resistor layer 34 for at least 1 micrometer (μm) and is not in contact with the aluminum front electrodes to expose two ends 341 of the resistor layer 34. Then, the substrate 31 is put into a sintering furnace to sinter the outer coating layer 352 to the inner coating layer 351 at a high temperature of 450~700° C. to form a protecting layer 35 comprising the inner coating layer 351 and the outer coating layer 352. Therein, the outer coating layer 352 is an insulator mainly consisting of epoxy.

(f) Printing a mark 25: A mark, e.g. type mark, resistance mark, etc., is printed on the protecting layer 35 for chip resistor identification.

(g) Strip-splitting 26: The substrate 31 having a sheet shape is put into a rolling device to be split into a plurality of strips of the substrate 31 through pushing bending.

(h) Printing side electrodes 27: After splitting the substrate 31, a conductive material is printed on two side surfaces of each one of the strips of the substrate 31 to form two side electrodes 36 on the two ends 341 of the resistor layer 34, where the side electrodes 36 cover the aluminum front electrodes 33 and the aluminum rear electrodes 32. Then, the substrate 31 is put into a sintering furnace to sinter the side electrodes 36 to the aluminum front electrodes 33 and the aluminum rear electrodes 32 at a temperature of 150~250° C. for setting connection and conducting electricity between the aluminum front electrodes 33 and the aluminum rear electrodes 32 at the same side of the substrate 31. Therein, the side electrodes 36 are in contact with the aluminum front electrodes 33 having a low solid content of porous aluminum to connect to the resistor layer 34; and the side electrodes 36 is a metal electrode of copper, nickel, tin, or a combination thereof.

(i) Chip-splitting 28: After sintering the side electrodes 36, each one of the strips of the substrate 31 is split by a rolling device through pushing bending. A plurality of serially-arranged chip resistors consisted in each one of the strips of the substrate 31 are split into independent dices of the chip resistors, where each one of the dices of the chip resistors comprises two of the aluminum front electrodes 33, two of the aluminum rear electrodes 32, two of the side electrodes 36, the resistor layer 34, and the protecting layer 35 comprising the inner coating layer 351 and the outer coating layer 352.

(j) Plating 29: The dices of the chip resistors are put into a plating bath to be plated. A plating layer 37 is plated to be covered on each one of the side electrodes 36. The plating layer 37 comprises a layer of nickel and a layer of tin. The layer of nickel is used to protect the aluminum front electrodes 33; and, the layer of tin is used to weld the chip resistor onto a PCB. Therein, the layer of nickel also fill pores of the low solid content of porous aluminum of the aluminum front electrodes 33 to form aluminum/nickel front electrodes with the layer of tin for welding. The chip resistors using the aluminum terminal electrodes are anti-vulcanizing chip resistors applied to cars, base stations, and LED lights.

Thus, novel methods of fabricating aluminum terminal electrodes for chip resistor are obtained.

A resistor layer and a protecting layer can be further formed on the back side of the substrate 31 for achieving various requirements.

In order to solve the vulcanization problem of silver terminal electrodes of chip resistor, the present invention uses aluminum electrode to replace silver electrode. Since aluminum does not react with sulfur and thus obtains anti-vulcanization, the present invention proposes the use of aluminum terminal electrodes formed in a chemical or physical way to replace the original silver electrode to be used in chip resistors. Thus, the original vulcanization problem of silver terminal electrodes is solved for those chip resistors applied in automobile electronics. Since aluminum does not have a high conductivity as silver, the present invention provides the aluminum terminal electrodes for chip resistors as shown in FIG. 3A, FIG. 3B, FIG. 4A, FIG. 4B. For the chip resistor having a high resistance (higher than 1Ω), a resistor paste having a high resistance is used. The resistor paste containing a high solid content more than 76% is used to fabricate the aluminum terminal electrodes 33 for replacing the silver terminal electrodes. In FIG. 3A, the protecting layer 35 has a size the same as or greater than the resistor layer 34. Yet, as is different from the original silver electrodes used in chip resistors, the aluminum electrodes used in chip resistors may produce parasitic resistance owing to the oxidation on surface. When a test of short-time overload is processed to the chip resistor with 2.5 times of a rated voltage during fabrication, the parasitic resistance will be generated owing to the impact on the aluminum electrodes so that the resistance will be greatly deviated (±2%) to fail the test of short-time overload. Form Table 1, it is found that, when a lot of glass powder (>6 wt %) is added on making a thick-film aluminum paste, the short-time overload, ΔR/R, is controlled within required specification (±2%) under 2.5 times of a rated voltage for solving the parasitic resistance produced owing to the oxidation on surface and the failure of the test of short-time overload owing to the greatly deviated resistance (±2%). When a greater amount of glass powder (>10 wt %) is added on making the thick-film aluminum paste, the short-time overload is further controlled at ±0.1%, which is far lower than required specification (±2%).

Figure 5:
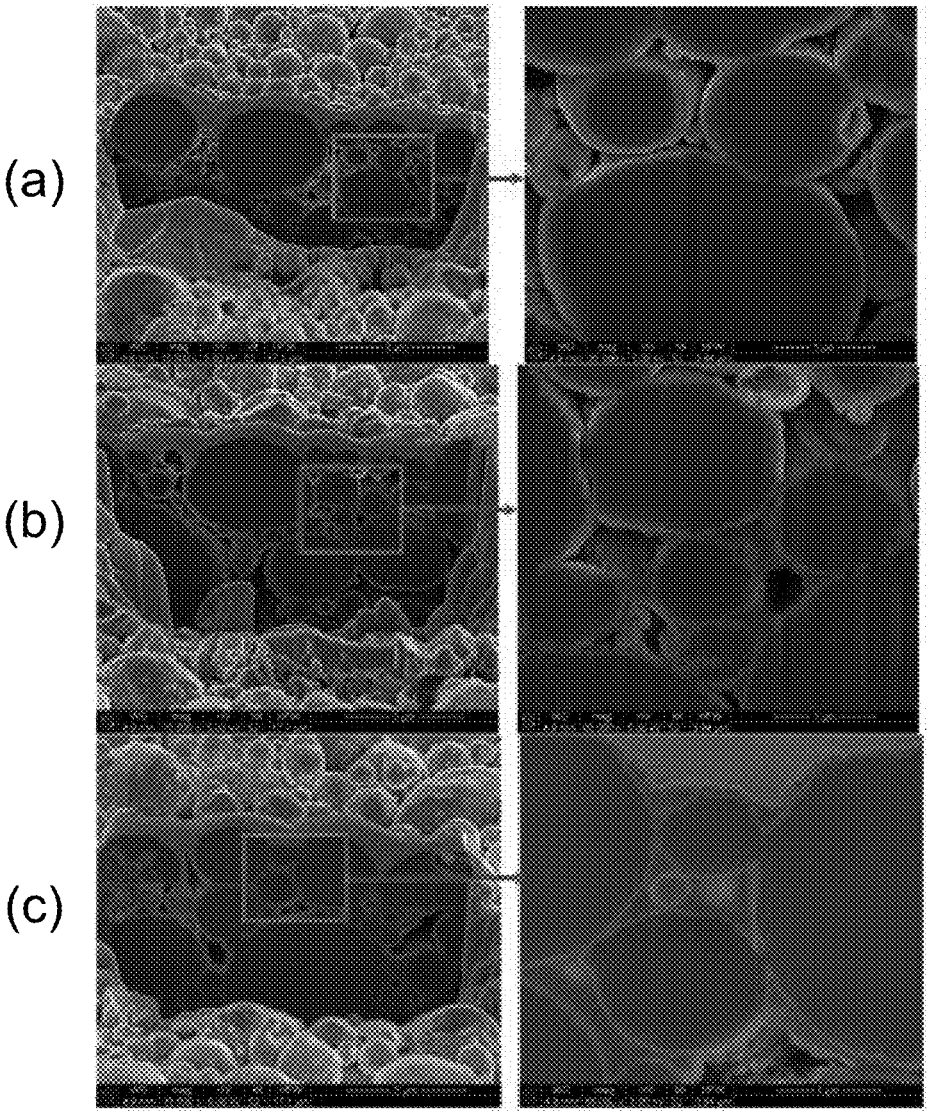
FIGS. 5(*a*)-(*c*) are the views showing the sintered aluminum electrodes having different glass contents.

When the great amount of glass is added to the thick-film aluminum paste, aluminum particles in the paste are prevented from over-oxidation during sintering because of the great amount of glass adhered on the surface. Moreover, with the great amount of glass added, pores leftover after sintering the thick-film aluminum paste are filled to greatly enhance the density of the aluminum electrode made of the thick-film aluminum paste. In FIG. 5, picture (a) shows the aluminum electrode added with 0% of glass; picture (b), 6%; and picture (c), 15%.

Thus, the chip resistor using the aluminum terminal electrodes fits the required specification (±2%), or has a better performance (±0.1%), for the test of short-time overload as compared to the chip resistor using the original silver terminal electrodes. Concerning the chip resistor having a low resistance (<1Ω), there are two solutions. One is to open holes to the protecting layer so that the plated metal (e.g. copper, nickel, tin or a combination thereof) can be connected outwardly. The other one, as shown in FIG. 4A, the low content of aluminum is made into porous aluminum and glass is filled during plating the metal (e.g. copper, nickel, tin or a combination thereof) to connect the protecting layer. Besides, the aluminum front electrodes 33 are made of porous aluminum instead of silver; and, the protecting layer 35 is shortened to expose the two ends 341 of the resistor layer 34 for directly plating the side electrodes 36 on the low-resistance resistor layer 34. Hence, the plated metal can be connected to the resistor layer 34 through porous aluminum, where the low-resistance resistor layer 34 is directly conducted with the plated metal to form novel terminal-electrode paths for solving the problem that a porous silver paste has a too high resistance to conduct from an assigned resistor layer.

TABLE 1

| | Diameter of aluminum particles ([Mu] m) | Aluminum solid content (wt %) | Glass content (wt %) | Sintering temperature (° C.) | Resistivity Ω-cm | $R_0$ (1 kΩ) | Load testing 2.5xRV ΔR/R (±%) |
|---|---|---|---|---|---|---|---|
| 1 | 6 | 75 | 0 | 600 | $6 \times 10^{-5}$ | 1.3 | −20 |
| 2 | 6 | 75 | 1 | 600 | $5 \times 10^{-6}$ | 1.2 | −15 |
| 3 | 6 | 75 | 2 | 600 | $8 \times 10^{-7}$ | 1.15 | −10 |
| 4 | 6 | 75 | 3 | 600 | $6 \times 10^{-7}$ | 1.10 | −5 |
| 5 | 6 | 75 | 4 | 600 | $6 \times 10^{-7}$ | 1.05 | −4 |
| 6 | 6 | 75 | 5 | 600 | $5 \times 10^{-7}$ | 1.02 | −3 |
| 7 | 6 | 75 | 6 | 600 | $5 \times 10^{-7}$ | 0.98 | −1.8 |
| 8 | 6 | 75 | 8 | 600 | $5 \times 10^{-7}$ | 0.95 | −0.5 |
| 9 | 6 | 75 | 10 | 600 | $6 \times 10^{-7}$ | 0.9 | −0.1 |
| 10 | 6 | 75 | 15 | 600 | $6 \times 10^{-7}$ | 0.87 | −0.05 |
| 11 | 6 | 75 | 0 | 900 | $4 \times 10^{-5}$ | 1.25 | −16 |
| 12 | 6 | 75 | 1 | 900 | $4 \times 10^{-6}$ | 1.18 | −13 |
| 13 | 6 | 75 | 2 | 900 | $6 \times 10^{-7}$ | 1.12 | −8 |
| 14 | 6 | 75 | 3 | 900 | $5 \times 10^{-7}$ | 1.08 | −4 |
| 15 | 6 | 75 | 4 | 900 | $5 \times 10^{-7}$ | 1.03 | −3 |
| 16 | 6 | 75 | 5 | 900 | $5 \times 10^{-7}$ | 1.00 | −2 |
| 17 | 6 | 75 | 6 | 900 | $4 \times 10^{-7}$ | 0.95 | −1.5 |
| 18 | 6 | 75 | 8 | 900 | $5 \times 10^{-7}$ | 0.92 | −0.3 |
| 19 | 6 | 75 | 10 | 900 | $5 \times 10^{-7}$ | 0.88 | −0.08 |
| 20 | 6 | 75 | 15 | 900 | $5 \times 10^{-7}$ | 0.86 | −0.03 |
| 21 | 2 | 75 | 0 | 600 | $5 \times 10^{-5}$ | 1.29 | −22 |
| 22 | 2 | 75 | 1 | 600 | $5 \times 10^{-6}$ | 1.22 | −16 |
| 23 | 2 | 75 | 2 | 600 | $4 \times 10^{-6}$ | 1.15 | −12 |
| 24 | 2 | 75 | 3 | 600 | $3 \times 10^{-6}$ | 1.13 | −7 |
| 25 | 2 | 75 | 4 | 600 | $2 \times 10^{-6}$ | 1.05 | −5 |
| 26 | 2 | 75 | 5 | 600 | $2 \times 10^{-6}$ | 1.04 | −4 |
| 27 | 2 | 75 | 6 | 600 | $2 \times 10^{-6}$ | 1.00 | −2 |
| 28 | 2 | 75 | 8 | 600 | $3 \times 10^{-6}$ | 0.93 | −0.6 |
| 29 | 2 | 75 | 10 | 600 | $3 \times 10^{-6}$ | 0.90 | −0.1 |
| 30 | 2 | 75 | 15 | 600 | $3 \times 10^{-6}$ | 0.88 | −0.07 |
| 31 | 6 | 85 | 0 | 600 | $2 \times 10^{-5}$ | 1.23 | −19 |
| 32 | 6 | 85 | 1 | 600 | $2 \times 10^{-6}$ | 1.17 | −16 |
| 33 | 6 | 85 | 2 | 600 | $5 \times 10^{-7}$ | 1.15 | −11 |
| 34 | 6 | 85 | 3 | 600 | $3 \times 10^{-7}$ | 1.05 | −4 |
| 35 | 6 | 85 | 4 | 600 | $2 \times 10^{-7}$ | 1.02 | −3.5 |

TABLE 1-continued

| | Diameter of aluminum particles ([Mu] m) | Aluminum solid content (wt %) | Glass content (wt %) | Sintering temperature (° C.) | Resistivity Ω-cm | $R_0$ (1 kΩ) | Load testing 2.5xRV ΔR/R (±%) |
|---|---|---|---|---|---|---|---|
| 36 | 6 | 85 | 5 | 600 | $1 \times 10^{-7}$ | 1.01 | −2.5 |
| 37 | 6 | 85 | 6 | 600 | $1 \times 10^{-7}$ | 0.99 | −1.4 |
| 38 | 6 | 85 | 8 | 600 | $2 \times 10^{-7}$ | 0.92 | −0.4 |
| 39 | 6 | 85 | 10 | 600 | $2 \times 10^{-7}$ | 0.89 | −0.07 |
| 40 | 6 | 85 | 15 | 600 | $2 \times 10^{-7}$ | 0.86 | −0.03 |
| 41 | 2 | 75 | 0 | 900 | $2 \times 10^{-5}$ | 1.25 | −24 |
| 42 | 2 | 75 | 1 | 900 | $9 \times 10^{-6}$ | 1.16 | −17 |
| 43 | 2 | 75 | 2 | 900 | $6 \times 10^{-6}$ | 1.13 | −13 |
| 44 | 2 | 75 | 3 | 900 | $5 \times 10^{-6}$ | 1.07 | −6 |
| 45 | 2 | 75 | 4 | 900 | $4 \times 10^{-6}$ | 1.05 | −5 |
| 46 | 2 | 75 | 5 | 900 | $4 \times 10^{-6}$ | 1.03 | −4 |
| 47 | 2 | 75 | 6 | 900 | $4 \times 10^{-6}$ | 0.99 | −1.9 |
| 48 | 2 | 75 | 8 | 900 | $5 \times 10^{-6}$ | 0.92 | −0.6 |
| 49 | 2 | 75 | 10 | 900 | $5 \times 10^{-6}$ | 0.89 | −0.09 |
| 50 | 2 | 75 | 15 | 900 | $5 \times 10^{-6}$ | 0.85 | −0.06 |

Figure 6:
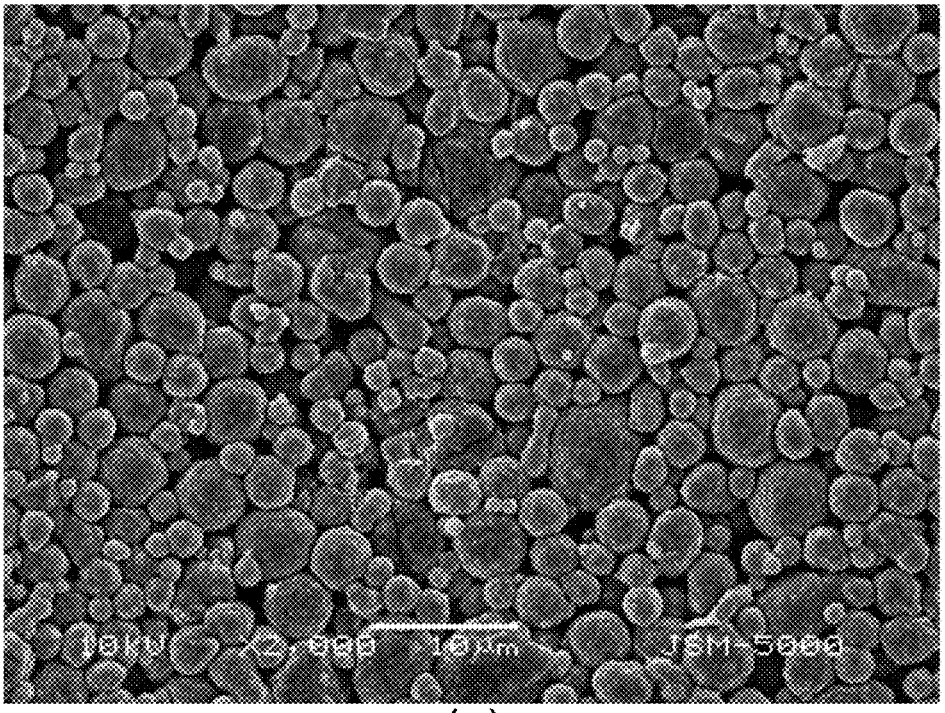
FIGS. 6(*a*)-(*b*) are the views showing the sintered aluminum electrodes fabricated according to the first and the second preferred embodiments.
Figure 6:
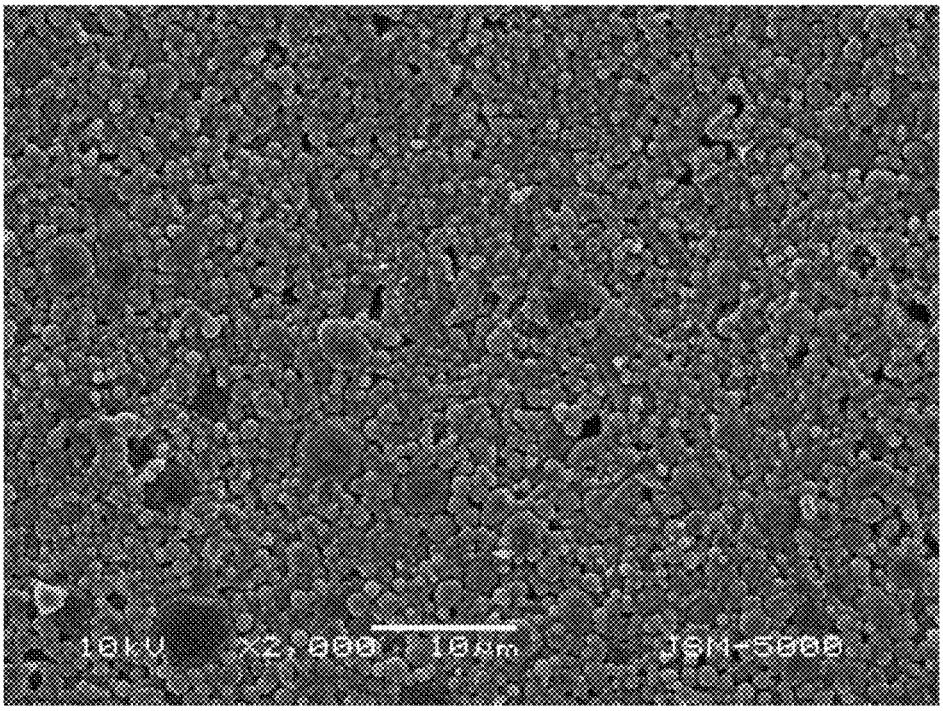

The present invention changes material and structure of terminal electrodes for chip resistor. For a high-resistance chip resistor, silver terminal electrode is directly replaced by the aluminum terminal electrode having a high solid content (comprising a high content of aluminum and a high content of glass). During the processes from printing to sintering and then to plating, the conductivity of the aluminum terminal electrodes is increased with the high content of aluminum; the oxidation problem during sintering aluminum is solved with the high content of glass; and the sintered aluminum terminal electrodes can be more compact. In the other hand, for a low-resistance chip resistor, the porous-aluminum terminal electrode replaces the original silver terminal electrode. Therein, a novel structure uses different sizes of a protecting layer and a resistor layer on conducting current paths to replace the traditional structure using the protecting layer and the resistor layer of the same size on conducting current paths. Or, the pores of porous aluminum are filled on plating a metal to form compact terminal electrodes having aluminum mixed with the metal. The sintered electrodes are shown in FIG. 6, where picture (a) shows the sintered aluminum terminal electrode for a low-resistance (100 mΩ) chip resistor and picture (b) shows the sintered aluminum terminal electrode for a high-resistance (100 KΩ) chip resistor.

Figure 7:
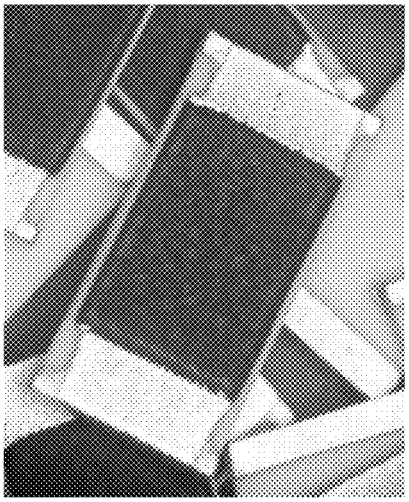
FIGS. 7 (*a*)-(*b*) are the views showing the vulcanization of the present invention and the prior art.
Figure 7:
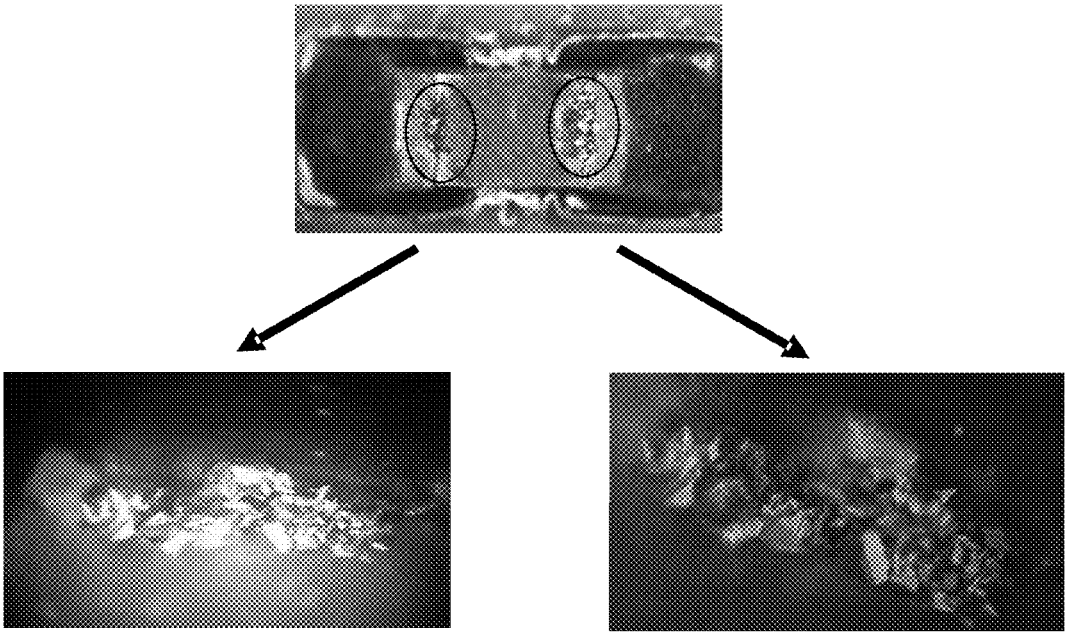

Concerning using aluminum terminal electrodes for chip resistors having different resistances, the protecting layer is does not decreased in size on being used in a high-resistance (1206/33 kΩ) chip resistor, which means the resistor layer can only conducted outwardly by the aluminum terminal electrode having a high solid content. Hence, the resistances before and after plating the side electrodes (e.g., plating copper, nickel, tin or a combination thereof) are almost the same, only that the conductivity of the aluminum terminal electrodes is increased by the high content of aluminum and, with the high content of glass, the oxidation problem during sintering aluminum is solved and the sintered aluminum terminal electrodes can be more compact. On the contrary, for a low-resistance (1206/200 mΩ) chip resistor, porous aluminum is used to fabricate the terminal electrode and the protection layer is reduced in size, where the resistance is greatly reduced and concentrated after plating the side electrodes. It means that, after plating the side electrodes, the resistor layer conducts out through new paths to replace the original aluminum front electrodes. The resistance changes of the above two chip resistor structures are shown in Table 2. Furthermore, for the traditional chip resistors using silver terminal electrodes as shown in picture (a) of FIG. 7 and the novel chip resistors using porous-aluminum terminal electrodes as shown in picture (b) of FIG. 7, an anti-vulcanization test is processed with a saturated sulfur vapor at a temperature of 105° C. for 1000 hours. The result is shown in FIG. 7 and Table 3. It is obvious that the chip resistors using porous-aluminum terminal electrodes can replace those using silver terminal electrodes to cure the vulcanization problem by being applied to anywhere silver is used with cost greatly reduced.

TABLE 2

| Resistance | 1206/200Ω | 1206/33 kΩ |
|---|---|---|
| Before plating | 267.5Ω | 31.8 kΩ |
| After plating | 197.5Ω | 31.6 kΩ |

TABLE 3

Vulcanization condition - Temperature: 105 +/− 2° C. Duration: 1000 hrs Saturated sulfur vapor: δR/R < 1%

| Chip resistor | Silver electrode 200Ω | Aluminum electrode 200Ω | Aluminum electrode 33 kΩ |
|---|---|---|---|
| 1 | 1.1 | −0.03 | 0.02 |
| 2 | — | −.004 | 0.01 |
| 3 | 2.3 | −0.03 | 0.00 |
| 4 | — | −0.02 | −0.02 |
| 5 | −0.5 | −0.03 | −0.01 |
| 6 | 1.7 | −0.04 | 0.02 |
| 7 | — | −0.03 | 0.00 |
| 8 | — | 0.00 | 0.01 |
| 9 | 2.1 | −0.03 | −0.02 |
| 10 | — | −0.03 | −0.03 |

The present invention uses nickel or copper for plating the side electrodes, which has a resistance lower than silver paste (even a paste having a high solid content of silver). The present invention uses nickel side electrodes to directly connect the low-resistance resistor layer for replacing the original connection to the resistor layer through front terminal electrodes. As a result, the front terminal electrodes are used for the side electrodes in processes as follows, whose conductivity acts for plating the side electrodes only. Hence, not only a paste having a low solid content of silver can be used; but also any other metal whose conductivity is suitable for plating the side electrodes is qualified, such as porous aluminum or copper. Besides, even when the nickel side electrodes connected to the resistor layer have resistance far lower than the resistor layer (even a low-resistance resistor layer is used), the final resistance of the whole chip resistor is not effectively influenced and, consequently, the resistance of a narrow-variation and low-resistance chip resistor can be controlled easily.

Hence, the present invention provides a novel material and structure for terminal electrodes used in chip resistor as shown in FIG. 4A. Low-cost porous-aluminum terminal electrodes are obtained to replace high-price silver terminal electrodes. When the aluminum terminal electrodes are used in a chip resistor having a high resistance, the structure (as shown in FIG. 3A) is not changed, but the aluminum terminal electrodes are increased in conductivity by a high solid content of aluminum and a high solid content of glass used to solve the oxidation problem during sintering aluminum and to make the sintered aluminum terminal electrodes more compact (as shown in FIG. 6). In the other hand, when the porous-aluminum terminal electrodes are used in a chip resistor having a low resistance (<1Ω), a novel structure is formed with different sizes of the protecting layer and the resistor layer to change the current conducting paths. Therein, the original paths of conducting to the resistor layer through the aluminum front electrodes are changed into new paths of conducting to the resistor layer through the side electrodes. Or, compact mixed terminal electrodes are formed by filling a metal in the pores of the porous-aluminum terminal electrodes on plating the side electrodes.

The present invention has two innovative advantages:

1. An aluminum terminal electrode having a high solid content (containing a high solid content of alumina and a high solid content of glass) or a terminal electrode of porous aluminum is obtained to replace the original silver terminal electrode to significantly reduce the cost of terminal electrode used in chip resistor.

2. An aluminum terminal electrode having a high solid content (containing a high solid content of alumina and a high solid content of glass) or a terminal electrode of porous aluminum is obtained to completely solve the vulcanization problem of silver terminal electrode used in chip resistor with great help for applications in automotive electronics.

To sum up, the present invention is methods of fabricating aluminum terminal electrodes for chip resistors, where an aluminum terminal electrode having a high solid content (containing a high solid content of alumina and a high solid content of glass) or a terminal electrode of porous aluminum replaces the original silver terminal electrode; a metal used for plating side electrodes is connected to a resistor layer through porous-aluminum front electrodes to conduct the low-resistance resistor layer out through the plated metal with new paths formed for terminal electrodes; and the present invention not only greatly reduces material cost of the terminal electrodes used in chip resistors but also completely solve the original vulcanization problem of silver electrodes for applications in cars, base stations, LED lights, etc.

The preferred embodiments herein disclosed are not intended to unnecessarily limit the scope of the invention. Therefore, simple modifications or variations belonging to the equivalent of the scope of the claims and the instructions disclosed herein for a patent are all within the scope of the present invention.

What is claimed is:

1. A method of fabricating a chip resistor using aluminum/glass terminal electrodes, comprising steps of:

(a) printing and sintering aluminum terminal electrodes having a content of aluminum and of glass, comprising steps of (a1) printing a plurality of pairs of aluminum rear electrodes on a back side of a substrate, wherein each pair of said aluminum rear electrodes are intervallic and unconnected;

(a2) printing a plurality of pairs of aluminum/glass front electrodes having a glass content of more than 6 wt % on a front side of said substrate, wherein each pair of said aluminum/glass front electrodes are intervallic and unconnected; and (a3) putting said substrate into a sintering furnace to sinter said aluminum/glass front electrodes and said aluminum rear electrodes to said substrate at a temperature of 600~900 Celsius degrees (° C.);

(b) printing and sintering a resistor layer, comprising steps of (b1) printing a resistor layer between each pair of said aluminum/glass front electrodes on said front side of said substrate, wherein two ends of said resistor layer are separately extended to said pair of said aluminum/glass front electrodes and only partially overlapped on said pair of said aluminum/glass front electrodes; and (b2) putting said substrate into a sintering furnace to sinter said resistor layer to said substrate at a temperature of 600~900° C.;

(c) printing and sintering a protecting layer, comprising steps of (c1) printing a protecting layer on said resistor layer, wherein said protecting layer completely overlaps the resistor layer; and (c2) putting said substrate into a sintering furnace to sinter said protecting layer to said resistor layer at a temperature of 450~700° C.;

(d) laser-cutting said resistor layer through the protecting layer with a laser to form an adjusting groove having a shape of "I" to adjust a resistance of said resistor layer;

(e) printing a mark on said protecting layer for chip resistor identification;

(f) strip-splitting, wherein said substrate having a sheet shape is put into a rolling device to be split into a plurality of strips of said substrate through pushing bending;

(g) printing side electrodes, comprising steps of (g1) printing a conductive material of copper, nickel, tin, or a combination thereof on two opposed side surfaces of each one of said strips of said substrate to obtain two side electrodes on said two ends of said resistor layer, wherein said side electrodes only partially contact said aluminum/glass front electrodes and completely contact said rear electrodes and overlie only portions of the protecting layer and do not contact the resistor layer; and (g2) putting said substrate strips in a sintering furnace to sinter said side electrodes to said aluminum/glass front electrodes and said aluminum rear electrodes at a temperature of 150~250° C. to obtain connection between pairs of said aluminum/glass front electrodes and said aluminum rear electrodes at the same side of said substrate, wherein said side electrodes are in contact with said aluminum/glass front electrodes to further indirectly connect to said resistor layer;

(h) chip-splitting, wherein, after sintering said side electrodes, each one of said strips of said substrate is split by a rolling device through pushing bending; and wherein a plurality of serially-arranged chip resistors in each one of said strips of said substrate is split into independent dices of said chip resistors and each one of said dices of said chip resistors comprises said two aluminum/glass front electrodes, said two aluminum rear electrodes, said two side electrodes, said resistor layer, and said protecting layer; and (i) plating said dices of said chip resistors in a plating bath with a layer of nickel to protect said two aluminum/glass front electrodes and so as to completely cover each said side electrode and with a layer of tin to weld said chip resistor onto a printed circuit board (PCB) and so as to completely cover each said side electrode, wherein said chip resistors using said aluminum/glass terminal electrodes are anti-vulcanizing chip resistors.

2. The method according to claim 1, wherein said aluminum/glass front electrode is applied to a chip resistor having a resistance not smaller than 1Ω.

3. The method according to claim 2, wherein said solid content of aluminum is higher than 64 wt % and wherein, after a test of short-time overload with 2.5 times of a rated voltage, ΔR/R is controlled within ±2%.

4. The method according to claim 2, wherein said solid content of said aluminum/glass front electrode is higher than 74 wt % and said solid content of aluminum is higher than 64 wt % and said solid content of glass is higher than 10 wt %; and wherein, after a test of short-time overload with 2.5 times of a rated voltage, ΔR/R is controlled within ±0.1%.

5. The method according to claim 1, wherein said aluminum/glass front electrode has a solid content of porous aluminum; and wherein said aluminum/glass front electrode is applied to a chip resistor having a resistance smaller than 1Ω.

6. The method according to claim 5, wherein said aluminum/glass front electrode has a solid content of porous aluminum lower than 44 wt % and a solid content of glass higher than 6 wt %.

7. A method of fabricating a chip resistor having aluminum/glass terminal electrodes, comprising steps of:

(a) printing and sintering aluminum/glass terminal electrodes having a content of porous aluminum and of glass, comprising steps of (a1) printing a plurality of pairs of aluminum rear electrodes on a back side of a substrate, wherein each pair of said aluminum rear electrodes are intervallic and unconnected;

(a2) printing a plurality of pairs of aluminum/glass front electrodes on a front side of said substrate, wherein each pair of said aluminum/glass front electrodes are intervallic and unconnected and have a solid content of porous aluminum and solid content of glass higher than 6 wt %; and (a3) putting said substrate into a sintering furnace to sinter the pairs of aluminum/glass front electrodes and the pairs of aluminum rear electrodes to said substrate at a temperature of 600~900° C., wherein said aluminum/glass front electrode has a solid content of porous aluminum;

(b) printing and sintering a resistor layer, comprising steps of (b1) printing a resistor layer between the pairs of aluminum/glass front electrodes on said front side of said substrate, wherein two ends of said resistor layer are separately extended to and only partially overlapped on the pairs of aluminum/glass front electrodes; and (b2) placing said substrate into a sintering furnace to sinter said resistor layer to said substrate at a temperature of 600~900° C.;

(c) printing and sintering an inner coating layer, comprising steps of (c1) printing an insulating inner coating layer consisting substantially of insulating glass on said resistor layer, wherein said inner coating layer has a size smaller than said resistor layer and is not in contact with the pairs of aluminum/glass front electrodes so as to expose two ends of said resistor layer; and (c2) putting said substrate into a sintering furnace to sinter said inner coating layer to said resistor layer at a temperature of 450~700° C.;

(d) laser-cutting the resistor layer through the insulating inner coating layer with a laser to form an adjusting groove having a shape of "I" on said resistor layer to adjust a resistance of said resistor layer;

(e) printing and sintering an outer coating layer, comprising steps of (e1) printing an insulating outer coating layer consisting substantially of epoxy on said inner coating layer having a size the same as said inner coating layer; and smaller than said resistor layer and is not in contact with the pairs of aluminum/glass front electrodes to expose two ends of said resistor layer; and (e2) putting said substrate into a sintering furnace to sinter said outer coating layer to said inner coating layer at a temperature of 450~700° C. to obtain a protecting layer comprising said inner coating layer and said outer coating layer;

(f) printing a mark on said protecting layer for chip resistor identification;

(g) strip-splitting, wherein said substrate having a sheet shape is put into a rolling device to be split into a plurality of substrate strips through pushing bending;

(h) printing side electrodes, comprising steps of (h1) printing a conductive material of copper, nickel, tin, or a combination thereof on two opposed side surfaces of each one of said strips of said substrate to obtain two side electrodes on said two ends of said resistor layer separately, wherein said side electrodes only partially contact said aluminum/glass front electrodes and completely contact said rear electrodes and directly contact and overlie opposed end portions of the resistor layer; and (h2) putting said substrate strips in a sintering furnace to sinter said side electrodes to said aluminum/glass front electrodes and said aluminum rear electrodes at a temperature of 150~250° C., wherein each one of said two aluminum/glass front electrodes is connected to a corresponding one of said aluminum rear electrodes through a corresponding one of said side electrodes at the same side of said substrate; and wherein said side electrodes are further directly connected with said resistor layer;

(i) chip-splitting, wherein, after sintering said side electrodes, each one of said strips of said substrate is split by a rolling device through pushing bending; and wherein a plurality of serially-arranged chip resistors are split into independent dices of said chip resistors and each one of said dices of said chip resistors comprises said two aluminum/glass front electrodes, said two aluminum rear electrodes, said two side electrodes, said resistor layer, and the protecting layer; and (j) plating said dices of said chip resistors in a plating bath with a layer of nickel so as to completely cover each said side electrode to protect said aluminum/glass front electrodes and to fill pores of said solid content of porous aluminum of said aluminum/glass front electrodes to obtain aluminum/glass/nickel front electrodes and with a layer of tin to weld said chip resistor onto a PCB and so as to completely cover each said side electrode, wherein said chip resistors using said aluminum/glass/nickel terminal electrodes are anti-vulcanizing chip resistors.

8. The method according to claim 7, wherein said aluminum/glass front electrode having said solid content of porous aluminum is applied to a chip resistor having a resistance smaller than 1Ω.

9. The method according to claim 8, wherein said aluminum/glass front electrode has said solid content of porous aluminum lower than 44 wt %.

10. The method according to claim 7, wherein said protecting layer has a size smaller than said resistor layer by at least 1 micrometer (μm).

11. The method of claim 5, wherein said plating said dices of said chip resistors in said plating bath with said layer of nickel fills pores of said solid content of porous aluminum of said aluminum/glass front electrodes to obtain aluminum/glass/nickel front electrodes.

* * * * *